US005265777A

United States Patent [19]

Weinstein

[11] Patent Number: 5,265,777

[45] Date of Patent: Nov. 30, 1993

[54] PUSH-PUSH TILTING DISPENSING CAP SYSTEM

[75] Inventor: Jack Weinstein, Manchester Township, Ocean County, N.J.

[73] Assignee: Primary Delivery Systems, Inc., Easton, Pa.

[21] Appl. No.: 885,027

[22] Filed: May 18, 1992

[51] Int. Cl.[5] ..... B67D 3/00

[52] U.S. Cl. ..... 222/517; 222/525

[58] Field of Search ..... 222/517, 522-525; 215/305, 315, 320

[56] References Cited

U.S. PATENT DOCUMENTS

| | | | |
|---|---|---|---|
| 2,695,737 | 11/1954 | Schlicksupp | 222/573 |
| 2,831,620 | 4/1958 | Schlicksupp | 222/517 |
| 3,221,952 | 12/1965 | De See | 222/525 |
| 3,283,966 | 11/1966 | Miller | 222/525 |
| 3,506,162 | 4/1970 | Schwartzman | 222/207 |
| 4,776,501 | 10/1988 | Ostrowsky | 222/577 |
| 4,848,600 | 7/1989 | Dark | 222/498 |
| 4,942,976 | 7/1990 | Spencer | 222/509 |
| 4,962,869 | 10/1990 | Gross et al. | 222/536 |
| 5,065,912 | 11/1991 | Rosenthal | 222/517 |

*Primary Examiner*—Jesus D. Sotelo

*Attorney, Agent, or Firm*—Kenneth P. Glynn

[57] ABSTRACT

The present invention involves a dispensing cap system for dispensing flowable material. It includes an inner cap which has an open bottom, a sidewall structure and top, as well as an orifice for dispensing which is located in the top of the inner cap. The inner cap may be attached to a container and has at least one vertical ratchet located on the outside of the sidewall structure so as to permit downward free motion and to prevent upward free motion of an outer cap, the vertical ratchet being adapted to engage such an outer cap when the outer cap is pressed downwardly. It also includes an outer cap having an open bottom, a sidewall structure and a top, the outer cap being movably fitted over the inner cap and the outer cap having an orifice for dispensing located on its top. The outer cap also has at least one vertical ratchet located on the inside of its sidewall and in alignment with the inner cap ratchet and is biased for downward free motion and upward locking of the outer cap be engaging the ratchet of the inner cap when the outer cap was pressed downwardly. The dispensing cap system also includes an outlet stem alignable with the orifices of the inner and outer caps for dispensing.

20 Claims, 2 Drawing Sheets

PUSH-PUSH TILTING DISPENSING CAP SYSTEM

BACKGROUND OF THE INVENTION

1. Field of the Invention

Present invention is directed to a dispensing cap system for dispensing flowable material from a container to which the cap is attachable. More specifically, the system is one including an inner cap and an outer cap wherein the outer cap may be pushed down on one side to open an outlet and pushed down on the opposite side to close the outlet. The dispensing cap system of the present invention may be used in conjunction with any available container for dispensing of any flowable material, including various liquids, emulsions, dispersions, creams, pastes and the like.

2. Prior Art Statement

There are literally thousands of United States patents which have issued to various types of dispensing caps for containers. Some of these cap designs involve the concept of pushing a cap to one side for dispensing and to an opposite side for closing. The following patents are believed to be of interest in that they pertain to dispensing caps with pushing involving tilting or swiveling. While the present invention also pertains to push caps which involves tilting or swiveling, it is believed that the following patents do not render the present invention anticipated or obvious:

U.S. Pat. No. 2,695,737, issued to Schlicksupp describes a self sealing closure mechanism for liquids. It involves a spout or nozzle member with a discharge aperture and valve seat coupled with a central post which supports a valve member such as a ball and spring. This is referred to as a ball joint connection and the spout is maintained in a normally closed position but may be pushed to one side so as to off center the dispensing orifice to allow liquids from a container to which this is attached to be dispensed.

U.S. Pat. No. 3,506,162, issued to Gilbert Schwartzman describes a spray applicator involving a squeeze mechanism which utilizes a spring loaded valve which opens and closes in response to pressure on the sidewalls of a container to which it is attached.

U.S. Pat. No. 4,776,501, describes a self closing, press to open dispensing closure. This may involve the use of journal segments under a rotating cap mechanism which is pressed down for dispensing and which utilizes a spring to return it to its closed position.

U.S. Pat. No. 4,848,600, issued to Richard Dark, describes a self closing dispensing valve utilizing a spring mechanism and a push arrangement for dispensing.

U.S. Pat. No. 4,942,976, issued to Steven Spencer, describes a container closure with a spicket valve which utilizes a lever which is pulled up and pushed down to open and close the seated valve.

U.S. Pat. No. 4,962,869, issued to Richard Gross et al, describes a toggle-acting dispensing closure with impact resistance which has a deformable resistance post to provide the resistance to light pressure but to enable pivoting of an actuator cap when substantially higher force is applied. This is utilized only for the initial opening and the device subsequently relies upon a spring member and a pivoting mechanism for opening and closing.

U.S. Pat. No. 5,065,912, issued to Karl-Heinz Rosenthal, describes a biased swivel closure which relies upon a v-shaped leaf spring and the closure cap pivots and opens upon being pressed but immediately closes upon release of the pressure.

Notwithstanding formidable prior art on the subject of closures and swivel type dispensing caps, it is believed that the prior art does not teach or suggest the present invention wherein an inner cap and outer cap are utilized such that the outer cap is in a first position with a closed dispensing orifice and may be pressed down into a second position so that the outer cap swivels downwardly to one side upon depression for opening and remains in that position even after the pushing pressure is released. Further, in the present invention, the outer cap is pressed on the opposite side from the opening position to release the pivoted outer cap so as to spring back to its original closed position.

SUMMARY OF THE INVENTION

The present invention involves a dispensing cap system for dispensing flowable material such as liquids, pastes, creams and the like from a container to which the cap system is attachable. It includes an inner cap which has an open bottom, a sidewall structure and top, as well as an orifice for dispensing which is located in the top of the inner cap. The inner cap also has means for attachment to a container and also has at least one vertical ratchet located on the outside of the sidewall structure so as to permit downward free motion and so as to prevent upward free motion of an outer cap, the vertical ratchet being adapted to engage such an outer cap when the outer cap is pressed downwardly. It also includes an outer cap having an open bottom, a sidewall structure and a top, the outer cap being movably fitted over the inner cap and the outer cap having an orifice for dispensing located on its top. The outer cap also has at least one vertical ratchet located on the inside of its sidewall and in alignment with the inner cap ratchet and biased for downward free motion and upward locking of the outer cap by engaging the ratchet of the inner cap when the outer cap was pressed downwardly. The dispensing cap system also includes an outlet stem aligned with the orifices of the inner and outer caps such that when the outer cap is positioned downwardly, the stem permits flowable material to pass through the orifices of the caps for dispensing and such that when the outer cap is in the opposite position, the stem does not permit flowable material to pass through the orifices of the inner and outer cap. At least one spring member is also included which is located between the inner cap and the outer cap so as to bias the outer cap upwardly.

BRIEF DESCRIPTION OF THE DRAWINGS

The present invention is more fully understood when the specification herein is taken in conjunction with the drawings appended hereto. These drawings are.

DETAILED DESCRIPTION OF THE PRESENT INVENTION

The present invention is specifically directed to a push-to-open, push-to-close dispensing cap system. Utilizes an inner cap and an outer cap and may be made of conventional closure materials such as selected plastics and polymers. It is preferred that they be constructed of plastics with slight deformability so as to yield more readily to certain pressures utilized as more fully described below. The present invention push-push tilting or pivoting dispensing cap system utilizes a first or inner cap for attachment to a container of choice and for receiving an outer cap thereon. There is included at least one spring member located between the outer cap and inner cap to bias the outer cap upwardly (and generally in parallel with the inner cap). Outlet orifices on the inner cap and outer cap are generally aligned and a stem extends from one cap to the other so as to not permit dispensing when the outer cap is in a first position and so as to permit dispensing when the outer cap is in a second position. Means for holding the outer cap down is generally described as one or more pairs of ratchets, it being understood that equivalent mechanisms such as protrusions and slots which would function to produce the identical result should be construed as being included within the word "ratchet" as used herein. These ratchets engage one another when the outer cap is pushed downwardly so as to tilt, bias or pivot the outer cap in a downward position. This is achieved by a user pushing on the outer cap at an area approximately above or near the ratchets. Closure or shifting of the outer cap to its upward position is achieved by merely pushing down on the side opposite from the side which is used to push down for ratchet engagement. In other words, ratchet disengagement is achieved by pushing down on the side opposite from the ratchet engagement areas.

Figure 1:
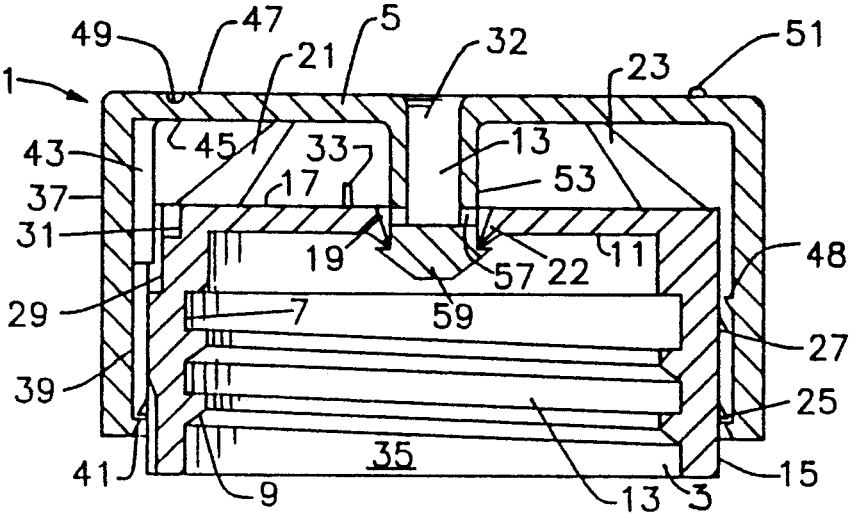
FIG. 1, which shows a front cut view of a dispensing cap system of the present invention wherein the stem for dispensing is connected to the outer cap.

Referring now to FIG. 1 there is shown generally a present invention push-push tilting dispensing cap system 1. This includes inner cap 3 and outer cap 5. Inner cap 3 includes sidewall structure 7, top 11 and open bottom 35. It also contains means for attachment to a container and, in this case, threads 9 are provided. However, force fit, snap in, in locks or other non-mechanisms for attachment of caps to containers may be utilized. Further, these caps may be attached permanently or so as to be non-removable. For example, if threaded, and it is desired that they be permanently attached, then one way ratchets within the threading can be used. Other mechanisms for permanent attachments are well known and may be included as attachment means for the inner cap of the present invention dispensing cap system. Inner cap 3 also includes top 11 with orifice 19 and with fulcrum 33 attached to the outside 17 of top 11 of inner cap 3. On the outside 15 of sidewall structure 7 is ratchet 27 which permits downward movement but prevents upward movement. This is used in conjunction with ratchet 48 on outer cap 5 described below. Optional rim 25 located on the outside 15 of sidewall structure 7 and rim 41 on the inside 39 of sidewall structure 37 are included to keep outer cap 5 permanently attached to and in alignment with inner cap 3. However, stem head 59 likewise acts to retain outer cap 5 on inner cap 3 in a nonremovable manner.

In the present invention dispensing cap systems, spring members or biasing means are included and at least one is required to maintain an upward bias of outer cap 5 with respect to inner cap 3. In this particular embodiment, spring members 21 and 23 are shown and they may be free floating, i.e. separate members located between the two caps or may be fixedly attached to either the outside 17 of top 11 of inner cap 3 or the inside 45 of top 47 of outer cap 5.

Referring now to outer cap 5 of FIG. 1, there is included stem 53 with internal annulus or opening 13. Within the wall of stem 53 is orifice 57 and attached thereto is stem cap 59. As shown is FIG. 1, no fluid material may leave a container to which the device is attached because stem and stem cap 59 in the position shown in FIG. 1 close off inner cap 3 dispensing orifice 19 at orifice rim 22.

Outer cap 5 includes sidewall structure 37 and top 47 and has a dispensing orifice 32 located in top 47. Sidewall structure 37 has on its inside wall 39, a ratchet 48 which is aligned with ratchet 27 of inner cap 3. When the user pushes down on outer cap 5 at indicia 51, outer cap 5 may slightly distort but, in any event, tilts downwardly on the right as one looks at FIG. 1 so that ratchet 48 slides over ratchet 27 and then engages thereunder so as to lock and hold outer cap 5 in a downward position and so as to prevent free motion upwardly. Further, spring 23 is depressed and pushes upwardly on outer cap 5 as long as ratchet 48 and ratchet 27 are engaged. While they are engaged, that is, while outer cap 5 is in its downward position, stem 53 is likewise downwardly biased and a space occurs between orifice 19 and stem cap 59 permitting the flow of material through orifice 19 and into opening 57 and out channel 13 and ultimately out through dispensing orifice 32 in outer cap 5. In order to facilitate the closure of the dispensing capability of the cap system of the present invention, indicia 49 is shown whereby user now would push on indicia 49 so as to pop ratchet 48 off of ratchet 27 and allow springs 21 and 23 to recover outer cap 5 to its upwardly biased position. Optional features which enhance the release of ratchet 48 and 27 include fulcrum 33 to create leverage as well as stop 29 located on the outside of sidewall structure 7 of inner cap 3. Additionally, extension 43 on the inside of sidewall structure 37 of outer cap 5 and the recess 31 on sidewall structure 7 of inner cap 3 may be utilized as a lock for keeping the system 1 from dispensing material while being shipped. In other words, it could be a slide lock with a groove type of mechanism whereby the user would first have to slightly rotate the cap to pop it permanently into a position where it could not be opened and closed in accordance with the present invention. However, this would merely be an optional feature which could be utilized by the manufacturer of such a present invention device and need not be construed as a critical feature or limit thereto. Alternatively, the cap could be taped, a tear strip could be utilized, a plastic weld which would have to be broken could be utilized or any other packaging mechanism to secure the cap for shipping to prevent dispensing during shipping would be within the purview of the artisan.

Figure 2:
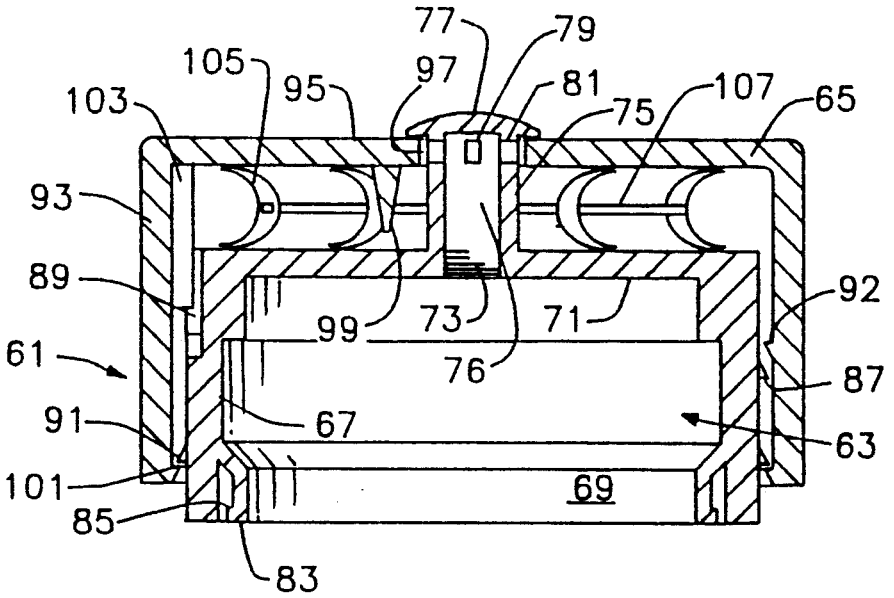
FIG. 2 shows a front cut view of an alternative embodiment of the present invention dispensing cap system wherein the dispensing stem is connected to the inner cap.

Referring now to FIG. 2, there is shown another front cut view of an alternative embodiment of present invention push-push tilting dispensing cap system 61. Here, inner cap 63 has sidewall structure 67, open bottom 69, top 71 and dispensing orifice 73. Attached thereto is stem 75 with stem cap 77 and outlets such as outlets 79 and 81. Inner cap 63 also includes a flange 83 with a locking mechanism 85 for permanent snap on attachment to a container with a rim or lip neck. Further, stop member 91 is included on the outside of the wall structure 67 to prevent outer cap 65 from being removed from inner cap 63. Additionally, ratchet 87 is included on the outside of wall structure 67 and this functions similarly to ratchet 27 described in conjunction with inner cap 30, FIG. 1 above. Stem 75 includes channel 76 and is seated in orifice 97 of outer cap 65. Fulcrum 99 is attached to the inside of the top 95 of outer cap 65. Further, inside cap 63 has recess 89 and outer cap 65 has protrusion 103 for a locking mechanism for shipping to prevent dispensing somewhat similar to that described above and again, within the ability of one ordinary skill in the art.

Spring member 105 is an annular set of springs tied together by plastic vertical tie member 107. In this embodiment, the spring is somewhat like a wheel and is placed over stem 75 and atop of inner cap 63 and then outer cap 65 is snapped over stem head 77 and stop 91 for securing the system 61, as shown. Outer cap 65 includes in its sidewall structure 93, a ratchet 92 which engages and disengages with respect to ratchet 87. This ratchet 92 functions similarly to ratchet 48 described in conjunction with FIG. 1 above. When a user pushes down on the right side of outer cap 65, ratchet 92 slides over ratchet 87 and engages therein to lock outer cap 65 in a tilted, downward position. At that point, a container to which the cap system 61 is attached may be squeezed or tipped upsidedown or otherwise utilized to dispense flowable material through dispensing orifice 73, through channel 76, through outlets 79 and 81 and thereby through outer cap 65 outlet 97. If a user presses down on the left side of cap 65, this will force the ratchets 87 and 92 to disengage and allow spring members such as 105 to return outer cap 65 to its upwardly biased position and thereby shutting off openings 81 and 79 and sealing dispensing orifice 97 with stem cap 77.

Figure 3:
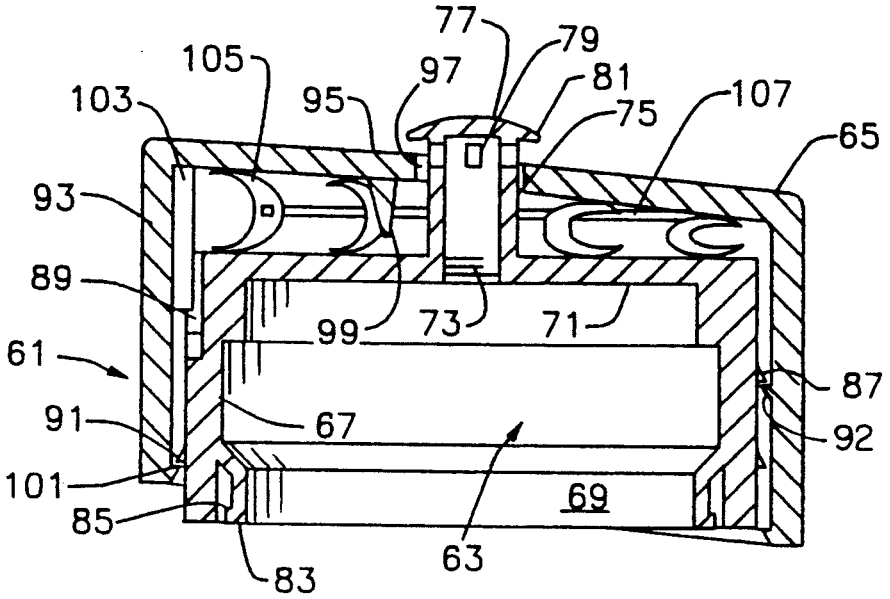
FIG. 3 shows the present invention system of FIG. 2 but in the open position with the outer cap being pressed downwardly so as to pivot; and, FIG. 4 shows a side cut view of yet another alternative embodiment present invention dispensing cap system wherein dispensing occurs only when the outer cap is not pivoted downwardly, that is, dispensing occurs only when the outer cap is biased upwardly.

FIG. 3 shows the device of FIG. 2 but in its downwardly biased position. Like parts are identically numbered and need not be repeated here. However, it should be noted that some slight distortion occurs with respect to outer cap 65 and, unless tolerances are determined accurately with adequate spacing, outer cap 65 will require at least some slight flexing and flexibility. FIG. 3 clearly illustrates the ability for fluid materials to exit a device to which cap system 61 may be attached.

Figure 4:
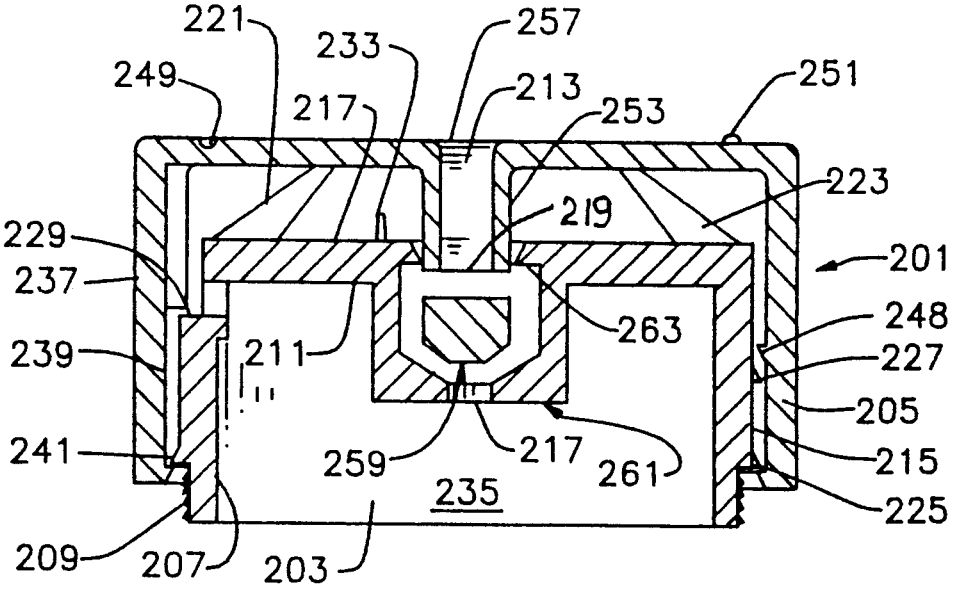

FIG. 4 shows a side cut view of yet another alternative embodiment present invention cap system 201. Inner cap 203 and outer cap 205 are shown with outer cap 205 nesting on top of inner cap 203. Inner cap 203 includes sidewall structure 207, top 211 and open bottom 235. It also contains means for attachment to a container and, in this case, threads 209 are provided. Inner cap 203 also includes orifice 219 in top 211, with fulcrum 233 attached to the outside 217 of top 211 of inner cap 203. On the outside 215 of sidewall structure 207 is ratchet 227 which permits downward movement but prevents upward movement. This is used in conjunction with ratchet 248 on outer cap 205 described below. Optional rim 225 located on the outside 215 of side wall structure 207 and rim 241 on the inside 239 of sidewall structure 237 are included to keep outer cap 205 permanently attached to and in alignment with inner cap 203. However, stem head 259 likewise acts to retain outer cap 205 on inner cap 203 in a nonremovable manner.

In the present invention dispensing cap systems, as mentioned above, spring members or biasing means are included and at least one is required to maintain an upward bias of outer cap 205 with respect to inner cap 203. In this particular embodiment, spring members 221 and 223 are shown and they may be free floating, i.e. separate members located between the two caps or may be fixedly attached to either the outside 217 of top 211 of inner cap 203 or the inside 245 of top 247 of outer cap 205.

Referring now to outer cap 205 of FIG. 4, there is included stem 253 with internal annulus or opening 213. Within the wall of stem 253 is orifice 257. Plug 259 is located below stem 253 and within well 261 formed in top 211 of inner cap 203. Plug 259 is molded as an extension of stem 253. Top 211 includes opening 263 into which stem 253 extends and includes opening 219 which is the female counterpart to plug 259. As shown in FIG. 4, fluid material may leave a container to which the device is attached because stem 253 is upwardly biased and plug 259 is in the open position. As mentioned, sidewall structure 237 has on its inside wall 239, a ratchet 248 which is aligned with ratchet 227 of inner cap 203. When the user pushes down on outer cap 205 at indicia 251, outer cap 205 may slightly distort but, in any event, tilts downwardly on the right as one looks at FIG. 4 so that ratchet 248 slides over ratchet 227 and then engages thereunder so as to lock and hold outer cap 205 in a downward position and so as to prevent free motion upwardly. Further, spring 223 is depressed and pushes upwardly on outer cap 205 but does not move outer cap 205 as long as ratchet 248 and ratchet 227 are engaged. While they are engaged, that is, while outer cap 205 is in its downward position, stem 253 is likewise downwardly biased and it pushes plug 259 into opening 219, prohibiting the flow of material through orifice 219 and into channel 213 and ultimately out through dispensing orifice 257 in outer cap 205. In order to facilitate the opening of the dispensing capability of the cap system of the present invention, indicia 249 is shown whereby user now would push on indicia 249 so as to pop ratchet 248 off of ratchet 227 and allow springs 221 and 223 to recover outer cap 205 to its upwardly biased position. Optional features which enhance the release of ratchet 248 and 227 include fulcrum 233 to create leverage as well as stop 229 located on the outside of sidewall structure 207 of inner cap 203.

Obviously, numerous modifications and variations of the present invention are possible in light of the above teachings. It is therefore understood that within the scope of the appended claims, the invention may be practiced otherwise than as specifically described herein.

What is claimed is:

1. A dispensing cap system for dispensing flowable material from a container to which said cap system is attachable, comprising:

(a) an inner cap having an open bottom, a sidewall structure and top, and having an orifice for dispensing located in the top of said inner cap, having means to attach said inner cap to a container, and further having at least one vertical ratchet located on the outside of said sidewall structure permitting downward free motion and preventing upward motion of an outer cap, said vertical ratchet adapted to engage an outer cap when that outer cap is pressed downwardly;

(b) an outer cap having an open bottom, a sidewall structure and a top, and being movably fitted over said inner cap, said outer cap having an orifice for dispensing located on the top of said outer cap, and further having at least one vertical ratchet located on the inside of said sidewall and in alignment with the inner cap ratchet and being biased for downward free motion and upward locking of said outer cap by engaging the ratchet of said inner cap when said outer cap is pressed downwardly;

(c) an outlet stem aligned with said orifices of said inner cap and said outer cap such that when said outer cap is in one position of either positioned upwardly or positioned so as to be locked downwardly, said stem is located to permit flowable material to pass through the orifices of said cap, and when said outer cap is in the other position of either positioned upwardly or positioned so as to be locked downwardly, said stem does not permit flowable material to pass through said orifices, said outlet stem being attached to one of said inner cap and said outer cap; and (d) at least one spring member located atop the inner cap and under the top of the outer cap so as to bias said outer cap upwardly.

2. The dispensing cap system of claim 1 wherein said spring member is attached to said outer cap.

3. The dispensing cap system of claim 1 wherein said spring member is attached to said inner cap.

4. The dispensing cap system of claim 1 which further includes a fulcrum protrusion attached to the top of said inner cap on the opposite side of its orifice from said vertical ratchet such that when said outer cap is pressed downwardly on its top away from its ratchet, said fulcrum protrusion assists in forcibly releasing said outer cap from a locked position.

5. The dispensing cap system of claim 1 which includes a fulcrum protrusion attached to the inside of the top of said outer cap on the opposite side of its orifice from said vertical ratchet, such that when said outer cap is pressed downwardly on its top away from its ratchet, said fulcrum protrusion assists in forcibly releasing said outer cap from a locked position.

6. The dispensing cap system of claim 1 wherein said inner cap includes means for receiving a portion of said outer cap to act as a fulcrum for releasing the outer cap from a locked position and said outer cap includes a portion of its inside sidewall for nesting with and acting as a fulcrum with said means for receiving.

7. The dispensing cap system of claim 1 wherein said outer cap has said stem connected thereto.

8. The dispensing cap system of claim 7 wherein said stem has an annular extension downwardly from the orifice of said outer cap and has a hollow portion extending to dispense when said stem is in a predetermined position.

9. The dispensing cap system of claim 1 wherein said inner cap has said stem connected thereto.

10. The dispensing cap system of claim 9 wherein said stem has an annular extension downwardly from the orifice of said outer cap and has a hollow portion extending upwardly from the orifice of said inner cap.

11. A dispensing cap system for dispensing flowable material from a container to which said cap system is attachable, comprising:

(a) an inner cap having an open bottom, a sidewall structure and top, and having an orifice for dispensing located in the top of said inner cap, having means to attach said inner cap to a container, and further having at least one vertical ratchet located on the outside of said sidewall structure permitting downward free motion and preventing upward motion of an outer cap, said vertical ratchet adapted to engage and lock an outer cap when that outer cap is pressed downwardly;

(b) an outer cap having an open bottom, a sidewall structure and a top, and being movably fitted over and attached to said inner cap, said outer cap having an orifice for dispensing located on the top of said outer cap, and further having at least one vertical ratchet located on the inside o said sidewall and in alignment with the inner cap ratchet and being biased for downward free motion and upward locking of said outer cap by engaging the ratchet of said inner cap when said outer cap is pressed downwardly;

(c) an outlet stem aligned with said orifices of said inner cap and said outer cap such that when said outer cap is in one position of either positioned upwardly or positioned so as to be locked downwardly, said stem is located to permit flowable material to pass through the orifices of said cap, and when said outer cap is in the other position of either positioned upwardly or positioned so as to be locked downwardly, said stem does not permit flowable material to pass through said orifices, said outlet stem being attached to one of said inner cap and said outer cap; and (d) at least one spring member located atop the inner cap and under the top of the outer cap so as to bias said outer cap upwardly.

12. The dispensing cap system of claim 11 wherein said spring member is attached to said outer cap.

13. The dispensing cap system of claim 11 wherein said spring member is attached to said inner cap.

14. The dispensing cap system of claim 11 which further includes a fulcrum protrusion attached to the top of said inner cap on the opposite side of its orifice from said vertical ratchet such that when said outer cap is pressed downwardly on its top away from its ratchet, said fulcrum protrusion assists in forcibly releasing said outer cap from a locked position.

15. The dispensing cap system of claim 11 which includes a fulcrum protrusion attached to the inside of the top of said outer cap on the opposite side of its orifice from said vertical ratchet, such that when said outer cap is pressed downwardly on its top away from its ratchet, said fulcrum protrusion assists in forcibly releasing said outer cap from a locked position.

16. The dispensing cap system of claim 11 wherein said inner cap includes means for receiving a portion of said outer cap to act as a fulcrum for releasing the outer cap from a locked position and said outer cap includes a portion of its inside sidewall for nesting with and acting as a fulcrum with said means for receiving.

17. The dispensing cap system of claim 11 wherein said outer cap has said stem connected thereto.

18. The dispensing cap system of claim 17 wherein said stem has an annular extension downwardly from the orifice of said outer cap and has a hollow portion extending to dispense when said stem is in a predetermined position.

19. The dispensing cap system of claim 11 wherein said inner cap has said stem connected thereto.

20. The dispensing cap system of claim 19 wherein said stem has an annular extension downwardly from the orifice of said outer cap and has a hollow portion extending upwardly from the orifice of said inner cap.

* * * * *